US011357295B2

(12) United States Patent
Avent

(10) Patent No.: US 11,357,295 B2
(45) Date of Patent: Jun. 14, 2022

(54) BLEMISH CONCEALING TOE JEWELRY SYSTEM

(71) Applicant: Gertrina Avent, Upper Marlboro, MD (US)

(72) Inventor: Gertrina Avent, Upper Marlboro, MD (US)

( * ) Notice: Subject to any disclaimer, the term of this patent is extended or adjusted under 35 U.S.C. 154(b) by 327 days.

(21) Appl. No.: 16/751,398

(22) Filed: Jan. 24, 2020

(65) Prior Publication Data

US 2020/0297082 A1 Sep. 24, 2020

Related U.S. Application Data

(60) Provisional application No. 62/919,528, filed on Mar. 18, 2019.

(51) Int. Cl.
*A44C 9/00* (2006.01)
*A44C 15/00* (2006.01)

(52) U.S. Cl.
CPC ..... *A44C 15/009* (2013.01)

(58) Field of Classification Search
CPC ... A44C 15/009; A44C 9/0053; A44C 9/0076; A44C 9/0038; A44C 9/00; A44C 9/0084; A44C 9/0061; A61F 13/00085; A61F 2013/00829; A61F 13/105; A61F 13/068; A61F 2013/8497; A61F 13/063; A61F 2013/5055; A61F 15/004; Y10T 24/44983; Y10T 24/44991
USPC ..... 63/1.11, 15.9; D11/27
See application file for complete search history.

(56) References Cited

U.S. PATENT DOCUMENTS

| | | | | |
|---|---|---|---|---|
| 694,762 | A * | 3/1902 | Level | A61F 13/063 128/894 |
| 1,690,395 | A * | 11/1928 | Biren | A61F 13/063 128/893 |
| 2,015,497 | A * | 9/1935 | Scholl | A61F 13/063 128/894 |
| 2,740,401 | A * | 4/1956 | Crawford | A61F 13/063 128/894 |
| D362,505 | S | 9/1995 | Fabricant | |
| 3,091,383 | A1 | 1/2012 | Zahiri et al. | |
| 8,747,002 | B2 * | 6/2014 | Izkovitz | A45D 40/18 63/1.14 |
| 2002/0069671 | A1 * | 6/2002 | Richardson | A61F 13/068 63/15 |
| 2007/0232979 | A1 | 10/2007 | Montgomery | |
| 2013/0091895 | A1 * | 4/2013 | Hwang | A44C 9/02 63/15.1 |
| 2014/0350491 | A1 | 11/2014 | Bryant-Brown | |
| 2015/0119782 | A1 | 4/2015 | Osiecki | |

* cited by examiner

*Primary Examiner* — Jack W Lavinder
(74) *Attorney, Agent, or Firm* — Invention To Patent Services; Alex Hobson

(57) ABSTRACT

A blemish-concealing toe jewelry system; the blemish-concealing toe jewelry system includes an open-ended, hollow, semi-cylindrical brace including an interior surface and an exterior surface, a padded cushion member positioned on the interior surface, and an ornament affixed to the exterior surface of the brace. The brace is a functionally operative and decorative toe-ring configured to conceal, protect, and adorn blemishes on at least one toe of a user.

17 Claims, 5 Drawing Sheets

BLEMISH CONCEALING TOE JEWELRY SYSTEM

CROSS-REFERENCE TO RELATED APPLICATION(S)

The present application is related to and claims priority to U.S. Provisional Patent Application No. 62/919,528 filed Mar. 18, 2019, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of jewelry of existing art and more specifically relates to toe jewelry.

RELATED ART

Clavuses which are commonly known as corns, affect the toes and feet, and can come in a wide range of varieties. They can be either hard or soft, big or small, and either completely painless or sensitive to the touch. Corns can commonly result simply from popular shoe types and begin just as a small abrasion. They come about as a result of common sitting positions, too. Even the normal walking habits of today's consumers can quickly cause corns to pop up. The only common factors, in fact, are that corns are unsightly, they're often visible, and they clearly stand out. They don't leave a positive impression on the many who'll notice them, either. Devices exist for covering up corns such as corn pads or toe wedges, however, these products draw more attention to corns and other blemishes. A suitable alternative is desired.

U.S. Pub. No. 2002/0069671 to Richardine Richardson relates to a jewel patch and band. The described jewel patch and band includes an assortment of attractive jewel patches on bands for decoration or for covering corns and other blemishes on a person's foot when wearing sandals and other open-toed shoes.

SUMMARY OF THE INVENTION

In view of the foregoing disadvantages inherent in the known toe jewelry art, the present disclosure provides a novel blemish-concealing toe jewelry system. The general purpose of the present disclosure, which will be described subsequently in greater detail, is to provide a functional and decorative toe ring device for application upon toes afflicted by a corn. By semi-encircling the toe(s) to which it is applied, the device prevents the toe from direct and frictional contact with its neighboring toes and prevents the toe from direct and frictional contact with its hosting footwear.

A blemish-concealing toe jewelry system is disclosed herein. The blemish-concealing toe jewelry system includes an open-ended, hollow, semi-cylindrical brace including an interior surface and an exterior surface, a padded cushion member positioned on the interior surface, and an ornament affixed to the exterior surface of the brace. The brace comprises a resilient material such as but not limited to a thin metal sheeting coated with pliable plastic and/or rubber material. The flexibility of the brace allows the sidewalls to be slightly separated for application of the brace upon a toe, and then the sidewalls will comfortably cling to the toe. The ornament may include, three-dimensional objects extending from a center-top surface plane of the exterior surface of the brace, printed indicia, various decorative features, patterns, colors, themes and designs. The brace is a functionally operative and decorative toe-ring configured to conceal, protect, and adorn blemishes on at least one toe of a user.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a blemish-concealing toe jewelry system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to toe jewelry and more particularly to a blemish-concealing toe jewelry system as used to improve the means for concealing, preventing, and treating foot blemishes including hard and soft corns.

Generally, blemish-concealing toe jewelry system provides an ergonomic, easy-to-apply piece of toe jewelry that is specifically designed to conceal, cushion and adorn toe blemishes such as but not limited to corns. The product is meant to be comfortably worn for long periods of time. The blemish-concealing toe jewelry system features a hollow, semi-cylindrical brace with decorative designs and/or implements upon its top-surface plane. The brace comprises a resilient material such as but not limited to a thin metal sheeting, plastic, or other suitable materials protectively coated with pliable plastic and/or rubber material. This allows the sidewalls to be slightly separated for application of the invention upon a toe, and then the sidewalls will comfortably cling to the toe. The interior surface of the sidewalls may or may not be slightly textured to enhance comfortable wear.

The bottom plane of the top area of the brace may feature a cushioning material such as foam and/or absorbent padding. In certain embodiments, the cushioning material of the brace may be medicated with various substances meant to soothe the pain caused from corns and/or to even heal the corn. The individual units of the brace can be adorned with various decorative implements to include printed and tangible items. This adornment enhances the visual-appeal of the blemish-concealing toe jewelry system. In yet another alternative embodiment, the blemish-concealing toe jewelry system may include a multi-brace unit featuring a plurality of connected braces. The braces may or may not be staggered. Further, the invention may be provided as a kit that allows for users to personally decorate the units with various objects and icons. The brace may be made in various sizes, including sizes that correspond with individual toes. Such sizes may also include units for application upon the hallux. The brace may be made in variations of a toe crest pad. The blemish-concealing toe jewelry system may come in decorate-yourself kits allowing for personalization of the individual units.

Referring now more specifically to the drawings by numerals of reference, there is shown in FIGS. 1-5, various views of a blemish-concealing toe jewelry system 100.

Figure 1:
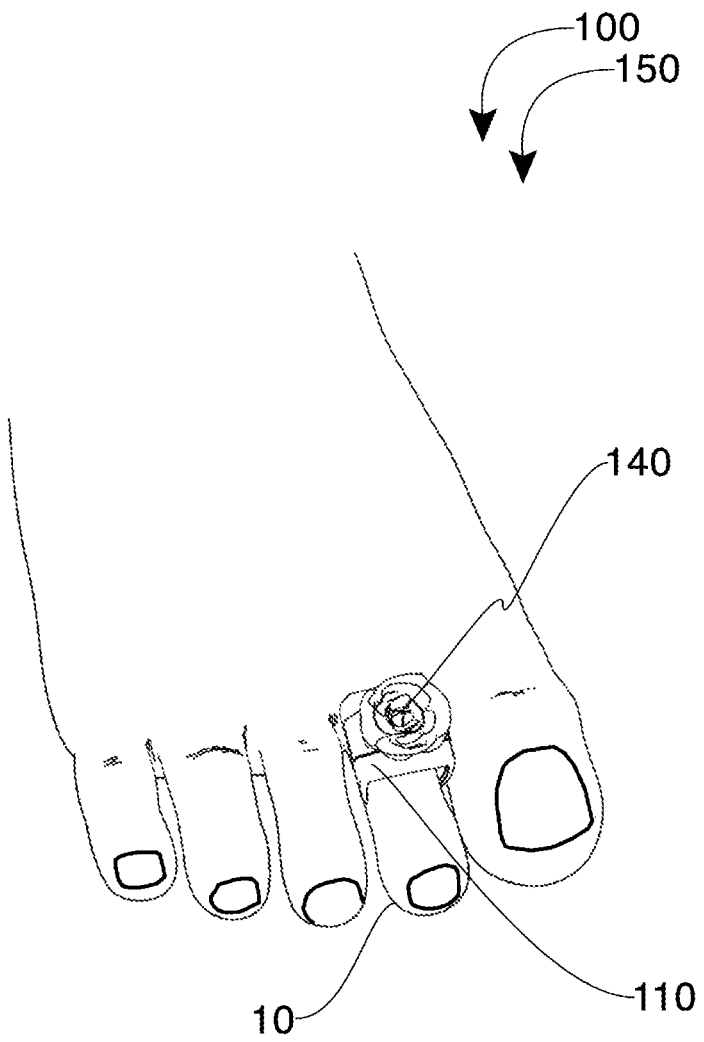
FIG. 1 is a perspective view of the blemish-concealing toe jewelry system during an 'in-use' condition, according to an embodiment of the disclosure.

FIG. 1 shows a blemish-concealing toe jewelry system 100 during an 'in-use' condition 150, according to an embodiment of the present disclosure. Here, the blemish-concealing toe jewelry system 100 may be beneficial for use by a user to prevent visibility of clavuses, protect clavuses, and prevent new clavuses from forming. As illustrated, the blemish-concealing toe jewelry system 100 may include an open-ended, hollow, semi-cylindrical brace 110 including an interior surface 112 and an exterior surface 116, a padded cushion member 130 positioned on the interior surface 112, and an ornament 140 affixed to the exterior surface 116 of the brace 110. The brace 110 comprises a circular profile such to contour the at least one toe 10 of a user. The brace 110 is a functionally operative and decorative toe-ring configured to conceal, protect, and adorn blemishes on at least one toe 10 of the user.

Figure 2:
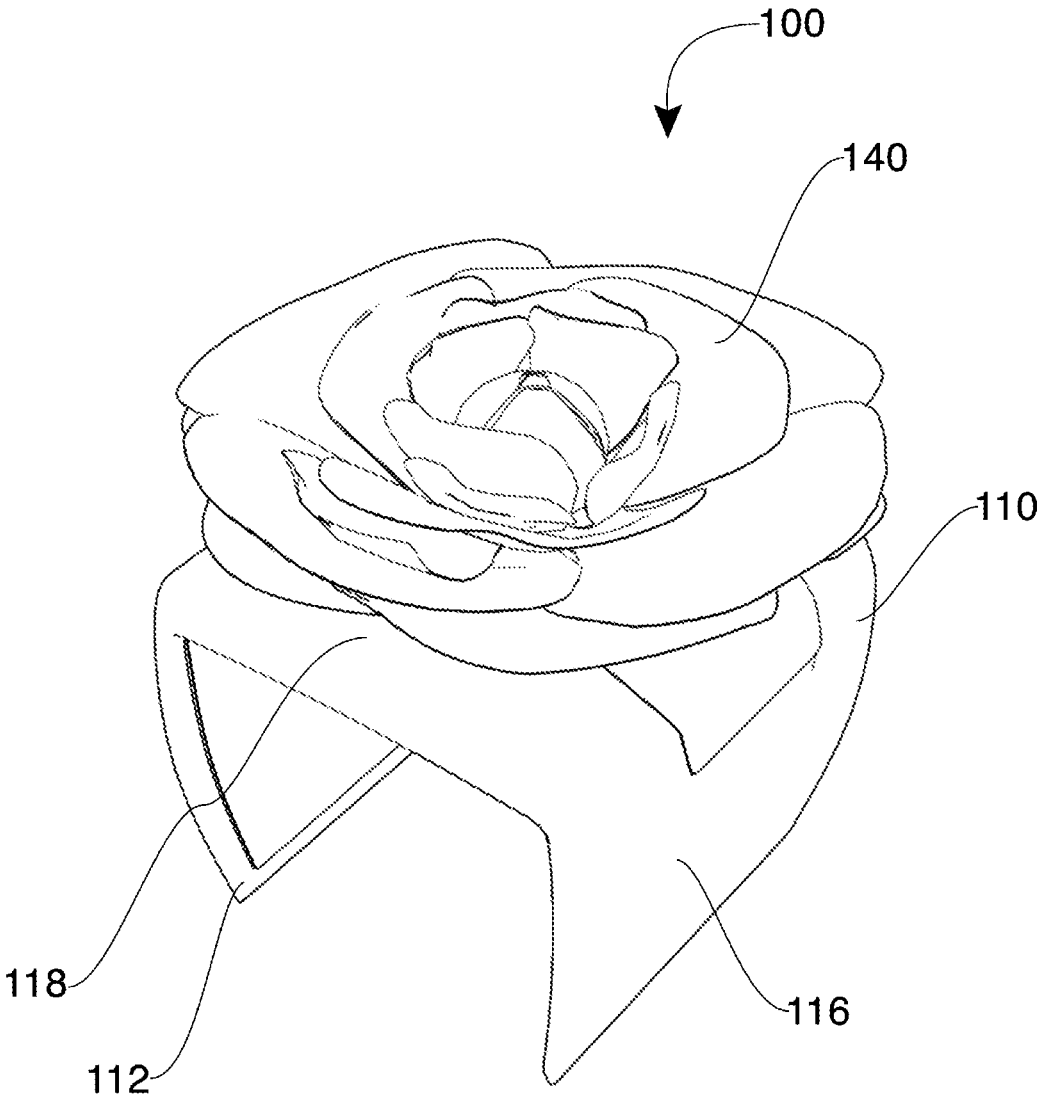
FIG. 2 is a top perspective view of the blemish-concealing toe jewelry system of FIG. 1, according to an embodiment of the present disclosure.

FIG. 2 shows the blemish-concealing toe jewelry system 100 of FIG. 1, according to an embodiment of the present disclosure. As above, the blemish-concealing toe jewelry system 100 may include the open-ended, hollow, semi-cylindrical brace 110 comprising the padded cushion member 130 positioned on the interior surface 112, and an ornament 140 affixed to the exterior surface 116 of the brace 110. The brace 110 is semi-flexible allowing for sidewalls 120 of the brace 110 to be adjusted. The flexibility of the sidewalls 120 allows the sidewalls 120 to be slightly separated for application of the brace 110 upon a toe 10, and then the sidewalls 120 will comfortably cling to the toe 10 of the user. In a preferred embodiment, the brace 110 comprises a resilient material such as but not limited to metal sheeting, aluminum alloy. The structure of the brace 110 may or may not be encased within a lining, and the lining may be made of various materials, including but not limited to polyvinyl chloride (PVC), silicone, polyurethane (PU), vinyl, cotton, polyester, and any combination of these and other materials. In certain versions of the blemish-concealing toe jewelry system 100, the interior surface 112 of the brace 110 further comprises textured sections 122 covering the sidewalls 120 of the brace 110.

Figure 3:
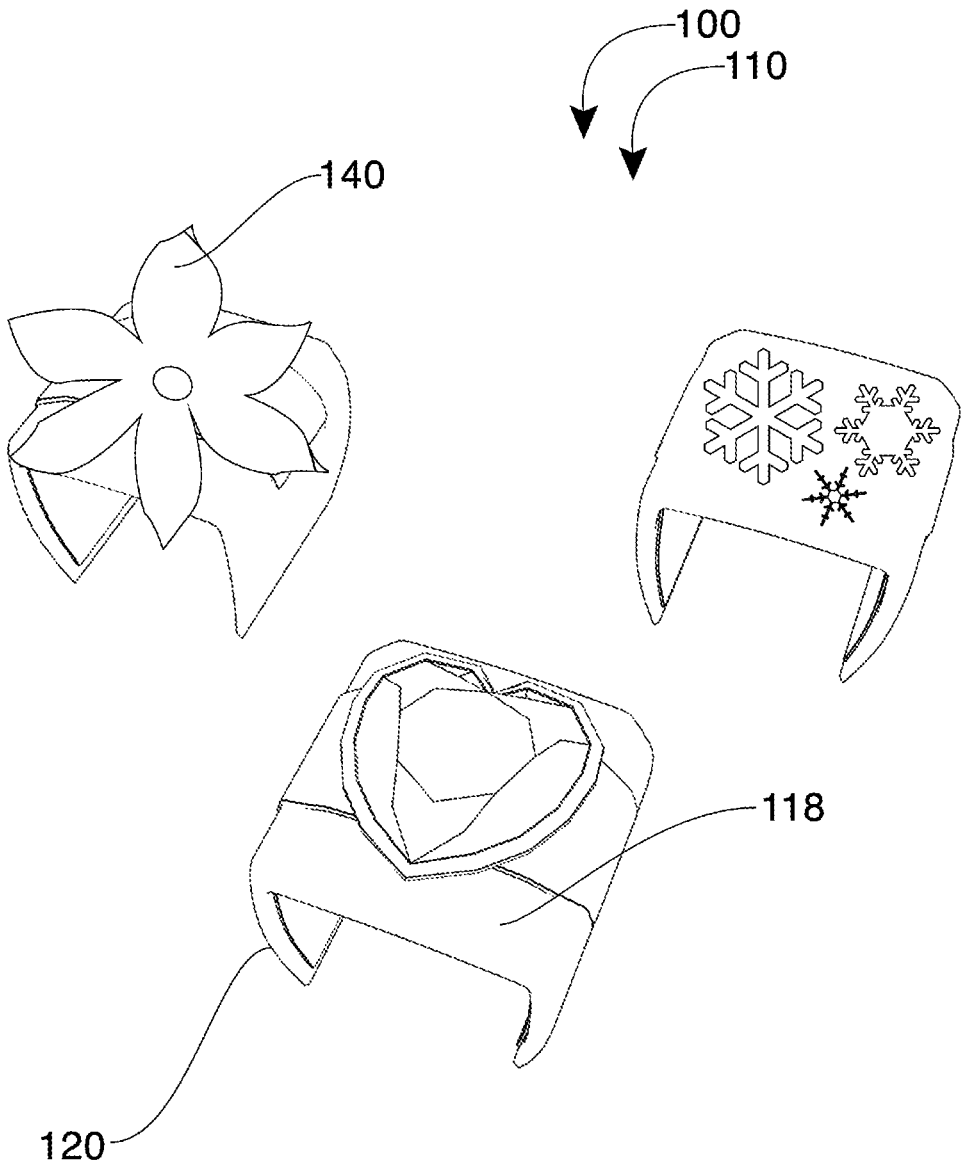
FIG. 3 is a perspective view of the blemish-concealing toe jewelry system of FIG. 1, according to an embodiment of the present disclosure.

FIG. 3 is a perspective view of the blemish-concealing toe jewelry system 100 of FIG. 1, according to an embodiment of the present disclosure. The brace 110 is shown in FIG. 3, having various ornaments 140 affixed to, and printed on the exterior surface 116 of the brace 110. The ornament 140 is affixed upon a center-top surface plane 118 of the exterior surface 116 of the brace 110. The center-top surface plane 118 of the exterior surface 116 of the brace 110 preferably comprises a flat profile. The ornament 140 may be three-dimensional and extend from the center-top surface plane 118 of the exterior surface 116 of the brace 110. In other embodiments, the ornament 140 includes printed indicia, various decorative features, patterns, colors, themes and designs. The decorative features can be made of various materials, such as but not limited to various plastics, metals, and glass, and in any combination of these and other materials. The brace 110 may be provided in variations in which the padded cushion member 130 is infused with a medicinal substance for the purposes of treating and/or removing the corn(s) with which the padded cushion member 130 has direct contact.

Figure 4:
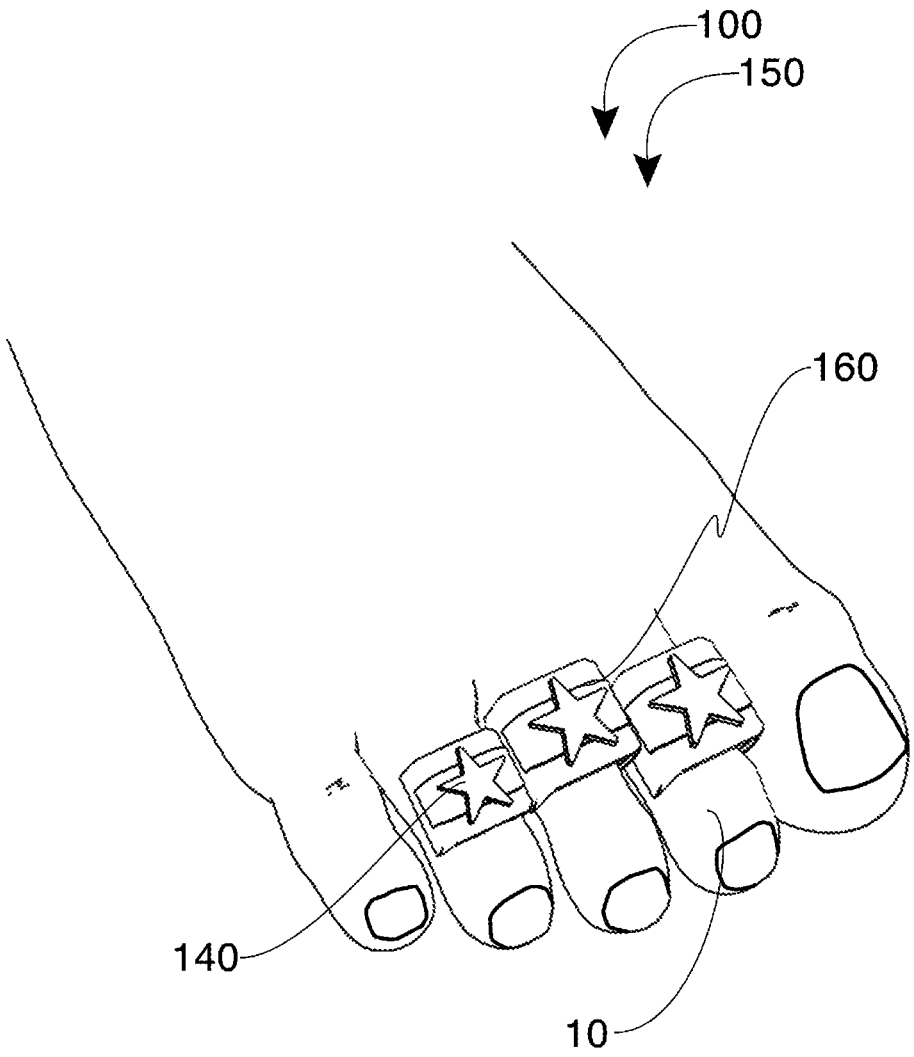
FIG. 4 is a perspective view of the blemish-concealing toe jewelry system of FIG. 1, according to an embodiment of the present disclosure.

FIG. 4 is a perspective view of the blemish-concealing toe jewelry system 100 of FIG. 1, according to an embodiment of the present disclosure. As shown in FIG. 4, the blemish-concealing toe jewelry system may be provided in a multi-brace unit 160. A plurality of the braces 110 adjoined on their sidewalls 120, together forming the multi-brace unit 160. The plurality of the braces 110 of the multi-brace unit 160 may be affixed together in a staggered or non-staggered position. In this embodiment, the multi-brace unit 160 is provided for application upon multiple toes 10, and that may or may not all be affected with corns. In such variations, each individual semi-cylindrical portion may or may not bear its own individual decoration, or the entire multi-toe unit 160 may be decorated with a single theme.

Figure 5:
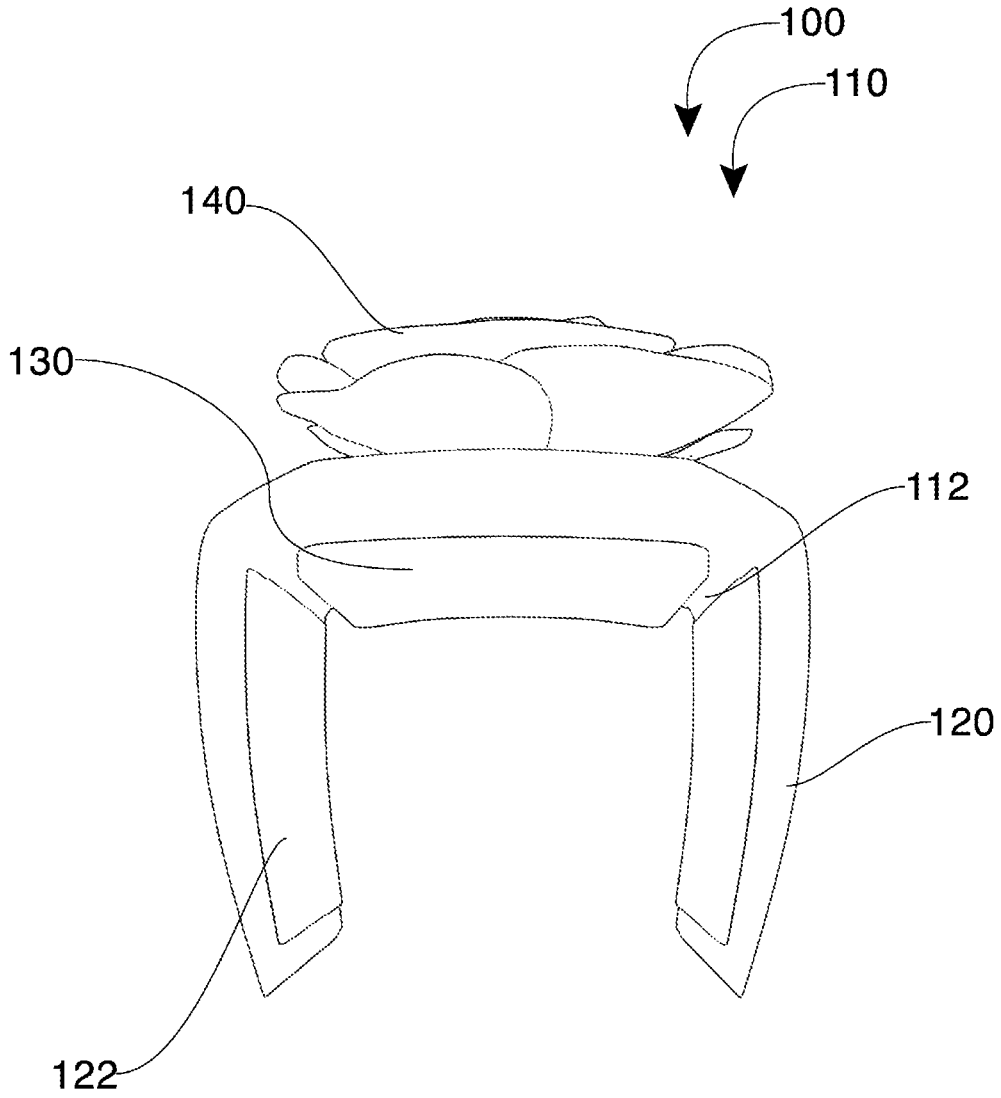
FIG. 5 is a front view of the blemish-concealing toe jewelry system of FIG. 1, according to an embodiment of the present disclosure.

FIG. 5 is a front view of the blemish-concealing toe jewelry system 100 of FIG. 1, according to an embodiment of the present disclosure. As shown in FIG. 5, the padded cushion member 130 is positioned along an interior arc of the brace 110 on the interior surface 112 opposing the center-top surface plane. The padded cushion member 130 within the interior surface 112 of the brace 110 can provide additional comfort to the pain caused by corns. Further, the padded cushion member 130 within the interior surface 112 of the brace 110 can prevent pain ordinarily caused by unwanted and/or accidental contact with corns. The padded cushion member 130 within the interior arc of the brace 110 may be of various sizes and depths and may comprise various materials such as but not limited to various foamed plastics, absorbent and non-absorbent materials, cloth materials, and any combination of these and other materials. In certain embodiments, the padded cushion member 130 may be removeable and replaceable. However, in a preferred embodiment, the padded cushion member 130 is non-removeable. In yet other variations, the brace 110 does not include the padded cushion member 130.

By semi-encircling the toe(s) 10 to which it is applied, the device prevents the toe 10 from direct and frictional contact with its neighboring toes 10 and hosting footwear. By preventing direct and frictional contact with neighboring toes 10 and hosting footwear, the brace 110 prevents the toe(s) 10 to which it is applied from developing corns as a result of that direct and frictional contact.

According to one embodiment, the blemish-concealing toe jewelry system 100 may be arranged as a kit. In particular, the blemish-concealing toe jewelry system 100 may further include a set of instructions. The instructions may detail functional relationships in relation to the structure of the blemish-concealing toe jewelry system 100 such that the blemish-concealing toe jewelry system 100 can be used, maintained, or the like, in a preferred manner. The kit allows users to personalize and decorate the braces 110 with various objects and icons.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A toe jewelry system comprising:

an open-ended, hollow, semi-cylindrical brace including an interior surface and an exterior surface, a padded cushion member positioned on the interior surface, and an ornament affixed to the exterior surface of the brace, wherein the brace is a functionally operative and decorative toe-ring configured to conceal, protect, and adorn blemishes on at least one toe of a user;

wherein the ornament is affixed to a center-top of the exterior surface;

wherein the center-top surface has a flat profile; and wherein the padded cushion member is positioned on the interior surface opposing the center-top surface plane.

2. The toe jewelry system of claim 1, wherein the brace comprises semi-flexible, adjustable sidewalls.

3. The toe jewelry system of claim 2, wherein the brace further comprises a resilient material.

4. The toe jewelry system of claim 3, wherein the brace further comprises a protective coating.

5. The toe jewelry system of claim 1, wherein the ornament includes printed indicia.

6. The toe jewelry system of claim 1, wherein the ornament is three-dimensional and extends from the center-top surface plane.

7. The toe jewelry system of claim 1, wherein the interior surface further comprises textured sections.

8. The toe jewelry system of claim 7, wherein the textured sections cover the sidewalls on the interior surface.

9. The toe jewelry system of claim 1, wherein the padded cushion member is absorbent.

10. The toe jewelry system of claim 9, wherein the padded cushion member is non-removeable.

11. The toe jewelry system of claim 9, wherein the padded cushion member is removeable and replaceable.

12. The toe jewelry system of claim 1, wherein the brace comprises a circular profile.

13. The toe jewelry system of claim 1, wherein a plurality of the braces are connected together, forming a multi-brace unit.

14. The toe jewelry system of claim 13, wherein the plurality of the braces of the multi-brace unit are in a staggered position.

15. A toe jewelry system comprising:

an open-ended, hollow, semi-cylindrical brace including an interior surface and an exterior surface, a padded cushion member positioned on the interior surface, and an ornament affixed to the exterior surface of the brace, wherein the brace is a functionally operative and decorative toe-ring configured to conceal, protect, and adorn blemishes on at least one toe of a user; and wherein the padded cushion member contains medicated substances.

16. A toe jewelry system comprising:

an open-ended, hollow, semi-cylindrical brace including an interior surface and an exterior surface, a padded cushion member positioned on the interior surface, and an ornament affixed to the exterior surface;

wherein the brace is a functionally operative and decorative toe-ring configured to conceal, protect, and adorn blemishes on at least one toe of a user;

wherein the brace comprises semi-flexible, adjustable sidewalls;

wherein the brace comprises a resilient material;

wherein the brace further comprises a protective coating;

wherein the ornament is affixed to a center-top of the exterior surface;

wherein the center-top surface plane is flat;

wherein the padded cushion member is positioned on the interior surface opposing the center-top surface plane;

wherein the ornament is three-dimensional and extends from the center-top surface plane;

wherein the interior surface of the brace further comprises textured sections;

wherein the textured sections cover the sidewalls;

wherein the padded cushion member is absorbent; and wherein the brace comprises a circular.

17. The toe jewelry system of claim 16, further comprising set of instructions; and wherein the toe jewelry system is arranged as a kit.

* * * * *